US005284193A

United States Patent [19]

Mires et al.

[11] Patent Number: 5,284,193

[45] Date of Patent: Feb. 8, 1994

[54] LOG SPLITTER

[76] Inventors: Ronald E. Mires, Rte. 4; Albert C. Crowder, 312 Lynn St., both of Ripley, Tenn. 38063

[21] Appl. No.: 100,369

[22] Filed: Aug. 2, 1993

[51] Int. Cl.[5] ..... B27L 7/00

[52] U.S. Cl. ..... 144/193 A; 144/193 R; 144/366; 414/745.8; 414/746.3

[58] Field of Search ..... 414/744.1, 745.8, 746.3; 144/3 K, 192, 193 R, 193 A, 366

[56] References Cited

U.S. PATENT DOCUMENTS

| | | | |
|---|---|---|---|
| 4,269,242 | 5/1981 | Smith et al. | 144/192 |
| 4,286,638 | 9/1981 | Connolly et al. | 144/3 K |
| 4,373,564 | 2/1983 | Heikkinen | 144/366 |
| 4,431,362 | 2/1984 | Wech, Jr. et al. | 414/685 |
| 4,520,854 | 6/1985 | May | 144/193 A |
| 4,544,008 | 10/1985 | Reini | 144/193 A |
| 4,842,030 | 6/1989 | Meyer | 144/193 A |

*Primary Examiner*—W. Donald Bray
*Attorney, Agent, or Firm*—Walker, McKenzie & Walker

[57] ABSTRACT

An improved log splitter having a first frame; a wedge fixedly attached thereto and extending outwardly therefrom; a carriage mounted for reciprocation upon the first frame; an abutment plate fixedly attached to the carriage and extending outwardly therefrom in alignment with the wedge and so arranged to split a log between the abutment plate and the wedge; and a hydraulic cylinder for reciprocating the abutment plate and carriage toward and away from the wedge, together with: a second frame rotatably mounted to the first frame so that the first frame may rotate relative thereto about an axis; a hydraulic piston-and-cylinder operably interposed between the first and second frame for rotating the first frame about its longitudinal axis; and a log support cradle extending outwardly from the carriage, with rollers on the cradle to ease positioning of a log. The first frame rotates between a loading position, in which a log on the ground is gripped between the abutment plate and the wedge, and a splitting position, in which the log is split, with the log being lifted onto the splitter as the first frame rotates.

14 Claims, 2 Drawing Sheets 2
2
5
5
6
6
8
8
20
22
23
24
26
28
30
36
38
40
42
48
54
56
58
60
62
64
66
68
70
72
74
76
78
82
84
86

7
7
20
22
24
26
28
30
36
38
68
70
72
74
76
78
80
84
86

4
4
20
38
40
58
60
62
68
70
72
80

20
22
23
24
26
28
36
38
68
78
L 20
22
23
40
42
48
58
60
62
64
66

20
22
23
26
66
68
70
78
80

LOG SPLITTER

BACKGROUND OF THE INVENTION

1. Field of the Invention

The present invention relates, in general, to apparatus for splitting logs, and in particular, to powered portable log splitters.

2. Information Disclosure Statement

Log splitting machines are well-known that drive a wedge into a log, either by moving the wedge into the log or by urging the log into the wedge, in order to split the log into smaller pieces for use as firewood. However, unsplit logs are very heavy, and significant effort is required to lift the logs onto the log splitter for subsequent splitting. Furthermore, once a log has been lifted onto the log splitter, the great weight and mass of the log make positioning and rotation of the log adjacent the splitting wedge difficult, if not dangerous.

It is therefore desirable to have an improved log splitter that can lift unsplit logs onto the splitter. It is further desirable that means be provided to facilitate the positioning and rotation of logs with respect to the splitting wedge of the log splitter.

A preliminary patentability search in Class 144, subclasses 193, 194, and 195, produced the following patents, some of which may be relevant to the present invention: Smith et al., U.S. Pat. No. 4,269,242, issued May 26, 1981; Wech, Jr. et al., U.S. Pat. No. 4,431,362, issued Feb. 14, 1984; May, U.S. Pat. No. 4,520,854, issued Jun. 4, 1985; Reini, U.S. Pat. No. 4,544,008, issued Oct. 1, 1985; and Meyer, U.S. Pat. No. 4,842,030, issued Jun. 27, 1989. While all of these references describe features of well-known log splitters, and some have hydraulic-powered arms for lifting logs, none disclose or suggest the improvements of the present invention.

SUMMARY OF THE INVENTION

The present invention is an improved log splitter having means for rotating the log splitter's frame along an axis from an upright first or splitting position to a rotated second or loading position so as to allow the splitter to grip, then lift, a log from the ground up onto the splitter. The log splitter further has a log support cradle comprising a plurality of outwardly extending arms with rollers thereon for supporting a log and allowing the log to be easily positioned for splitting.

It is an object of the present invention to provide means for lifting a log from the ground onto a log splitter for subsequent splitting, as well as means for supporting the log and easing the positioning of the log during the splitting operation.

DESCRIPTION OF THE PREFERRED EMBODIMENT

Figure 1:
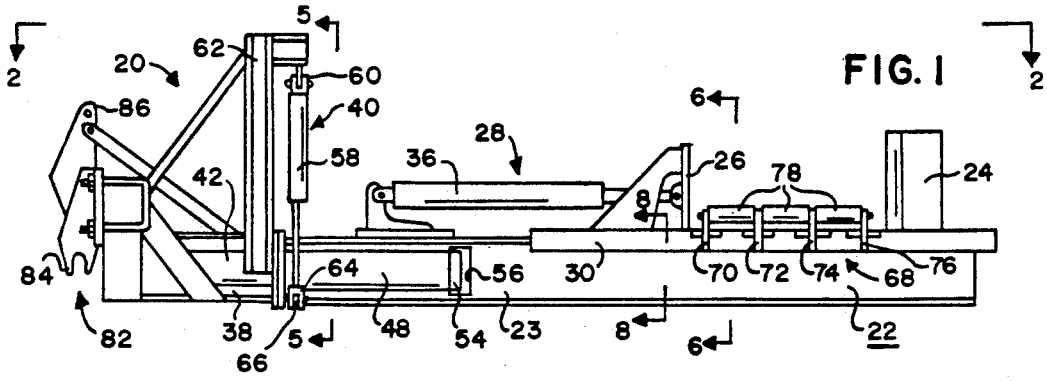
FIG. 1 is a side elevational view of the present invention with the first frame of the splitter shown in the upright first or splitting position.

Referring to FIGS. 1-9, the improved log splitter 20 of the present invention is seen to comprise a first frame 22, preferably including a well-known "I-beam" 23; a wedge 24 extending outwardly from first frame 22; a reciprocating abutment plate 26 extending outwardly from first frame 22 a variable distance from wedge 24 and in alignment with wedge 24, abutment plate 26 being so arranged as to split a log between wedge 24 and abutment plate 26 as abutment plate 26 and wedge 24 move relative to each other and the distance between wedge 24 and abutment plate 26 closes; and powered means 28 for closing the distance between abutment plate 26 and wedge 24 by moving abutment plate 26 and wedge 24 relative to each another in a manner well-known to those skilled in the art. These elements of log splitter 20 just described are well-known to those skilled in the art, being described, for example, in May, U.S. Pat. No. 4,520,854 (1985) and Reini, U.S. Pat. No. 4,544,008 (1985), both incorporated fully herein by reference.

Figure 8:
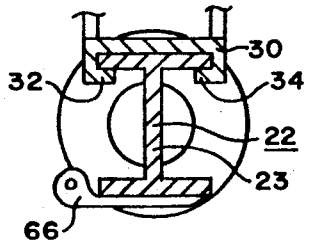
FIG. 8 is a partial transverse sectional view of the present invention showing the mounting of the carriage, taken substantially along the line 8—8 shown in FIG. 1.
Figure 9:
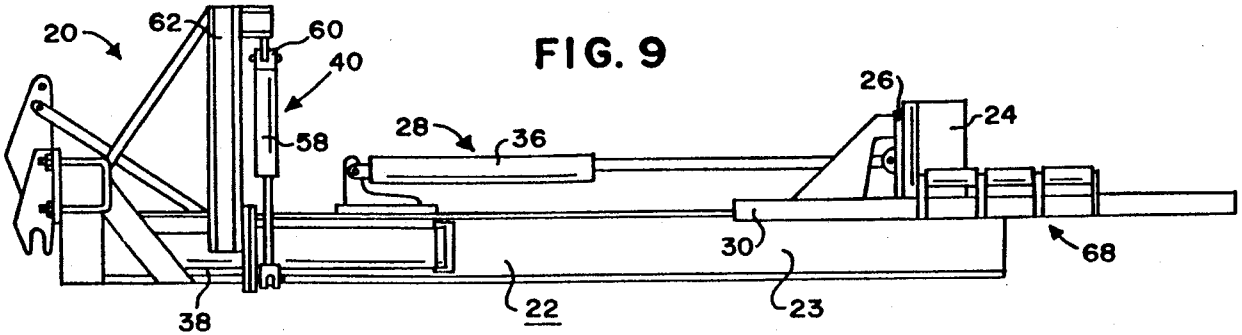
FIG. 9 is a side elevational view of the present invention, similar to FIG. 1, but with the abutment plate fully reciprocated against the wedge.

In the preferred embodiment, and as shown especially in FIG. 8, log splitter 20 includes a carriage 30 mounted to first frame 22, as by lips 32 and 34 gripping "I-beam. 23, for reciprocation thereupon, and abutment plate 26 is fixedly attached, as by welding, to carriage 30 and extends outwardly therefrom for simultaneous reciprocation therewith. Powered means 28 preferably includes a well-known hydraulic piston-and-cylinder 36, operably connected between carriage 30 and first frame 22 in a manner well-known to those skilled in the art, for reciprocation of carriage 30 toward and away from wedge 24, thereby splitting any log placed between abutment plate 26 and wedge 24 in a manner also well-known to those skilled in the art.

Figure 2:
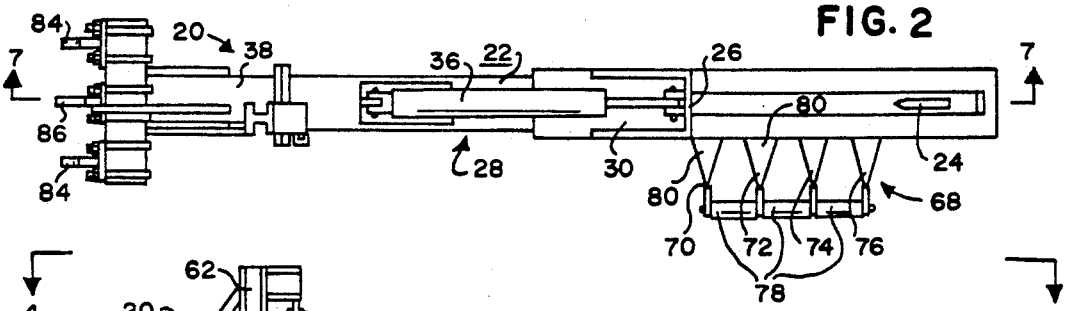
FIG. 2 is a top plan view of the present invention taken substantially along the line 2—2 shown in FIG. 1.
Figure 3:
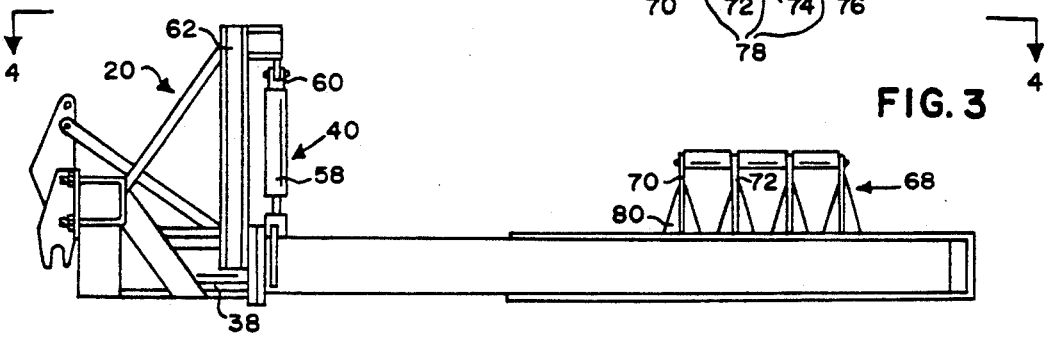
FIG. 3 is a side elevational view of the present invention with the first frame of the splitter shown in the rotated second or loading position.
Figure 4:
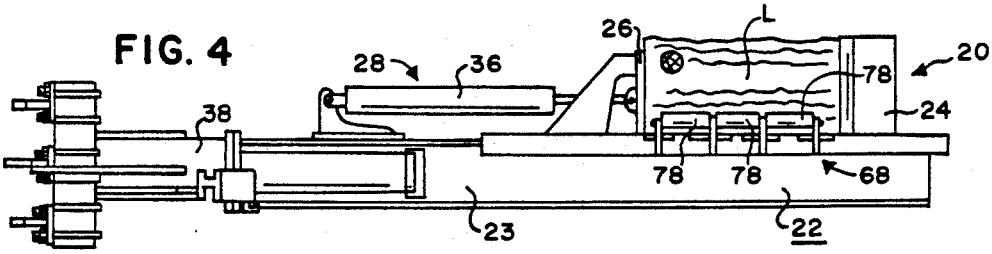
FIG. 4 is a top plan view of the present invention showing the gripping of a log, taken substantially along the line 4—4 shown in FIG. 3.

The improvements of the present invention include a second frame 38 rotatably mounted to first frame 22 so that first frame 22 may rotate relative to second frame 38 about a longitudinal first axis, and rotation means 40 for rotating first frame 22 about this first axis between an upright first or splitting position, shown in FIGS. 1 and 2, and a rotated second or loading position, shown in FIGS. 3 and 4, so that a log may be gripped and lifted onto the splitter 20.

Figure 7:
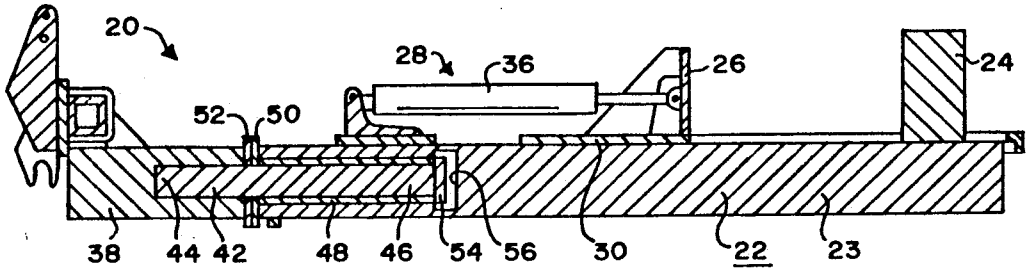
FIG. 7 is a longitudinal sectional view of the present invention, taken substantially along the line 7—7 shown in FIG. 2.

As best seen in FIG. 7, first and second frames 22 and 38 are preferably rotatably joined about a cylindrical metal pipe 42 having a first end 44 fixedly secured, as by welding, to second frame 38, and having a second end 46 received inside a close-fitting metal tube 48 so that tube 48 may rotate thereabout, it being understood that tube 48 is fixedly secured, as by welding, to I-beam 23 of first frame 22, thereby allowing first frame 22 to rotate about pipe 42 with pipe 42 serving as an axle.

The mounting of first and second frames 22 and 38 also includes a pair of circular bearing plates 50 and 52, respectively and fixedly secured to first and second frames 22 and 38, thereby providing a bearing surface therebetween against which first and second frames 22 and 38 rotate relative to each other. A cap 54 is fixedly secured, as by welding, to second end 46 of pipe 42, it being understood that the diameter of cap 54 is substantially larger than the inner diameter of tube 48, thereby preventing first and second frames 22 and 38 from becoming separated in a manner that will now be apparent. A cutout opening 56 is provided in I-beam 23 about cap 54 to allow for the rotation of I-beam 23 and tube 48 relative to cap 54.

Figure 5:
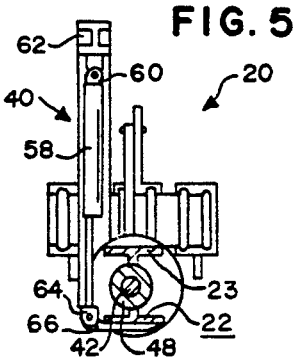
FIG. 5 is a transverse sectional view of the present invention showing the details of the rotation means and mounting 11 of the two frames,, taken substantially along the line 5—5 shown in FIG. 1.
Figure 6:
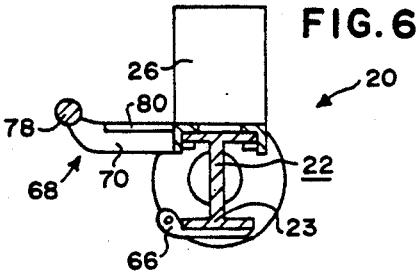
FIG. 6 is a transverse sectional view of the present invention showing the details of the carriage and of the arms and rollers f the log support cradle, taken substantially along the line 6—6 shown in FIG. 1.

Rotation means 40 of the present invention for rotating first frame 22 relative to second frame 38 preferably comprises a well-known hydraulic piston-and-cylinder 58 operably interposed between first and second frames 22 and 38. As shown in FIGS. 1 and 5, a first end 60 of hydraulic piston-and-cylinder 58 is coupled to a support member 62, support member 62 being upwardly extending from and fixedly attached, as by welding, to second frame 38, and a second end 64 of hydraulic piston-and-cylinder 58 is coupled to first frame 22 a radial distance from the axis of rotation of first frame 22 (i.e., from the center of pipe 42). Preferably, second end 64 of hydraulic piston-and-cylinder 58 is coupled to an arm 66 that is weldedly secured to I-beam 23 of first frame 22. For clarity. FIGS. 6 and 8 show arm 66 with hydraulic piston-and-cylinder 58 removed. It will now be understood that, as hydraulic piston-and-cylinder 58 lengthens and contracts in a manner well-known to those skilled in the art, first frame 22 is caused to rotate relative to second frame 38 about pipe 42 between an upright first or splitting position shown in FIGS. 1 and 2 in which wedge 24 is substantially vertically extended from first frame 22, and a rotated second or loading position, having an angle at least forty-five and preferably ninety degrees from the splitting position, as shown in FIGS. 3 and 4, so that a log L on the ground beside the splitter 20 may be gripped for subsequent lifting in a manner hereinafter described.

The improvements of the present invention also include a log support cradle 68 extending outwardly from first frame 22 substantially perpendicular to the direction of relative movement between wedge 24 and abutment plate 26. Preferably, cradle 68 comprises a plurality of support arms 70, 72, 74, and 76 fixedly secured, as by welding, to carriage 30, thereby causing cradle 68 to be in a fixed relation with abutment plate 26 for simultaneous movement therewith as carriage 30 reciprocates upon first frame 22. In this manner, a log L may be supported on cradle 68 and moved simultaneously with abutment plate 26 toward wedge 24 during splitting, with the cutting or splitting by wedge 24 being along a chord of log L so as to split an appropriately sized piece of firewood from log L.

Before each splitting reciprocation of carriage 30 occurs, it is necessary to position log L between abutment plate 26 and wedge 24. To ease this positioning of log L, the present invention also preferably comprises one or more rollers 78 mounted to cradle 68 for rotation with respect thereto about a second axis substantially parallel to the direction of relative movement between wedge 24 and abutment plate 26, thereby allowing log L to be easily rolled, without lifting, into position between wedge 24 and abutment plate 26 for subsequent splitting therebetween. Cradle 68 may also have braces 80 for providing rigidity for arms 70, 72, 74, and 76.

Second frame 38 may also have well-known attachment means 82 for attaching log splitter 20 to a tractor or the like, it being understood that the downwardly-extending grips 84 of attachment means 82 are received onto a well-known "tool bar" on a tractor, and bracket 86 may be attached to a well-known hydraulic cylinder-and-piston (not shown) for raising and lowering log splitter 20 during transport. Well-known hydraulic controls on such a tractor may be connected to splitter 20 in a manner well-known to those skilled in the art for operation of splitter 20.

To operate the improved splitter 20, first frame 22 is rotated into the loading position shown in FIGS. 3 and 4 with carriage 30 retracted, and a log L is rolled on the ground to a position between wedge 24 and abutment plate 26. Abutment plate 26 is then moved somewhat toward wedge 24 by powered means 28 until log L is gripped between wedge 24 and abutment plate 26. First frame 22 is then rotated into the splitting position shown in FIGS. 1 and 2, thereby lifting log L onto splitter 20, and carriage 30 is then retracted somewhat until log L is not gripped between wedge 24 and abutment plate 26. Log L is then rotated into position on log support cradle 68 until it is correctly positioned for splitting, at which time powered means 28 causes the distance between abutment plate 26 and wedge 24 to close by moving abutment plate 26 and wedge 24 relative to each other, thereby splitting log L in the well known manner. Carriage 30 is then retracted, log L is again rotatably positioned, and splitting again occurs, until the entire log has been converted to firewood.

Although the present invention has been described and illustrated with respect to a preferred embodiment and a preferred use therefor, it is not to be so limited since modifications and changes can be made therein which are within the full intended scope of the invention.

We claim:

1. An improved log splitter having: a first frame; a wedge extending outwardly from said first frame; an abutment plate extending outwardly from said first frame a distance from said wedge in alignment with said wedge and so arranged as to split a log between said wedge and said abutment plate as said distance between said wedge and said abutment plate closes; and powered means for closing the distance between said abutment plate and said wedge by moving said abutment plate and said wedge relative to each another, wherein the improvement comprises:

(a) a second frame rotatably mounted to said first frame so that said first frame may rotate relative to said second frame about a first axis; and (b) rotation means for rotating said first frame about said first axis between a splitting position and a loading position.

2. The log splitter as recited in claim 1, wherein said splitting position is defined by said wedge being vertically extended from said first frame and said loading position is defined by said first frame being rotated about said first axis an angle of at least forty-five degrees from said splitting position.

3. The log splitter as recited in claim 1, wherein said rotation means comprises a hydraulic piston-and-cylinder operably interposed between said first frame and said second frame.

4. The log splitter as recited in claim 3, wherein said hydraulic piston-and-cylinder is attached to said first frame a radial distance from said first axis.

5. The log splitter as recited in claim 1, wherein the improvement further comprises a log support cradle extending outwardly from said first frame substantially perpendicular to the direction of relative movement between said wedge and said abutment plate.

6. The log splitter as recited in claim 5, wherein said cradle and said abutment plate are in a fixed relation to each other.

7. The log splitter as recited in claim 5, wherein the improvement further comprises a roller mounted to said cradle for rotation with respect thereto about a second axis substantially parallel to the direction of relative movement between said wedge and said abutment plate.

8. An improved log splitter having: a first frame; a wedge fixedly attached thereto and extending outwardly therefrom; a carriage mounted for reciprocation upon said first frame; an abutment plate fixedly attached to said carriage and extending outwardly therefrom in alignment with said wedge and spaced a distance therefrom and so arranged as to split a log between said wedge and said abutment plate as said carriage is reciprocated to close said distance between said wedge and said abutment plate; and powered means for reciprocatingly moving said abutment plate toward and away from said wedge, wherein the improvement comprises:

(a) a second frame rotatably mounted to said first frame so that said first frame may rotate relative to said second frame about a first axis; and (b) rotation means for rotating said first frame about said first axis between a splitting position and a loading position.

9. The log splitter as recited in claim 8, wherein said rotation means comprises a hydraulic piston-and-cylinder operably interposed between said first frame and said second frame.

10. The log splitter as recited in claim 9, wherein said hydraulic piston-and-cylinder is attached to said first frame a radial distance from said first axis.

11. The log splitter as recited in claim 10, wherein the improvement further comprises a log support cradle fixedly attached to and extending outwardly from said carriage substantially perpendicular to the direction of reciprocating movement of said abutment plate.

12. The log splitter as recited in claim 11, wherein the improvement further comprises a roller mounted to said cradle for rotation with respect thereto about a second axis substantially parallel to the direction of reciprocating movement of said abutment plate.

13. An improved log splitter having: a first frame; a wedge fixedly attached thereto and extending outwardly therefrom; a carriage mounted for reciprocation upon said first frame; an abutment plate fixedly attached to said carriage and extending outwardly therefrom in alignment with said wedge and spaced a distance therefrom and so arranged as to split a log between said wedge and said abutment plate as said carriage is reciprocated to close said distance between said wedge and said abutment plate; and powered means for reciprocatingly moving said abutment plate toward and away from said wedge, wherein the improvement comprises:

(a) a second frame rotatably mounted to said first frame so that said first frame may rotate relative to said second frame about a first axis;

(b) rotation means for rotating said first frame about said first axis between a splitting position and a loading position, said rotation means comprising a hydraulic piston-and-cylinder operably interposed between said first frame and said second frame, said hydraulic piston-and-cylinder being attached to said first frame a radial distance from said first axis; and (c) a log support cradle fixedly attached to and extending outwardly from said carriage substantially perpendicular to the direction of reciprocating movement of said abutment plate.

14. The log splitter as recited in claim 13, wherein the improvement further comprises a roller mounted to said cradle for rotation with respect thereto about a second axis substantially parallel to the direction of reciprocating movement of said abutment plate.

* * * * *